US006487973B1

(12) United States Patent
Gilbert, Jr. et al.

(10) Patent No.: US 6,487,973 B1
(45) Date of Patent: Dec. 3, 2002

(54) METHOD AND APPARATUS FOR LOCKING CHARGES INTO A CHARGE HOLDER

(75) Inventors: William James Gilbert, Jr., Rio Vista, TX (US); Corbin Glenn, Benbrook, TX (US)

(73) Assignee: Halliburton Energy Services, Inc., Dallas, TX (US)

( * ) Notice: Subject to any disclaimer, the term of this patent is extended or adjusted under 35 U.S.C. 154(b) by 0 days.

(21) Appl. No.: 09/558,694

(22) Filed: Apr. 25, 2000

(51) Int. Cl.[7] ..... F42B 3/00
(52) U.S. Cl. ..... 102/312; 102/313
(58) Field of Search ..... 102/311, 312, 102/313; 86/20.15

(56) References Cited

U.S. PATENT DOCUMENTS 3,078,797 A * 2/1963 Blair
4,609,057 A * 9/1986 Walker et al. ..... 175/4.6
4,621,396 A * 11/1986 Walker et al. ..... 29/1.3
4,655,138 A * 4/1987 Regalbuto et al. ..... 102/307
4,716,833 A * 1/1988 Regalbuto ..... 102/320
4,739,707 A * 4/1988 Regalbuto et al. ..... 102/307
4,800,815 A * 1/1989 Appledorn et al. ..... 102/321
5,460,095 A * 10/1995 Slagle et al. ..... 102/307
5,862,758 A * 1/1999 Parrott ..... 102/312
5,952,603 A 9/1999 Parrott

* cited by examiner

*Primary Examiner*—Charles T. Jordan
*Assistant Examiner*—Kimberly S. Smith
(74) *Attorney, Agent, or Firm*—Paul I. Herman; David W. Carstens

(57) ABSTRACT

The invention uses a pair of opposed tabs on the charge holder to engage a groove in the case of the shape charge. The case is generally conical in shape. However, the front opening of the case has both a first and second circumferential ridge separated by a groove. The diameter of the groove generally matches the distance between tabs. The second ridge can have a flat milled thereon to allow case to be inserted until the tabs contact the forward or first ridge. This locates the tabs between the first and second ridges and over the groove. The case is then rotated so that the tabs are captured between the two ridges. Once installed, the detonation cord is attached to the case. The cord helps prevent any rotation of the case, thereby securing it into the charge holder. Thus, the use of easily milled tabs on the charge holder in conjunction with an easily milled groove and flats on the case provide an improved apparatus and method for securing the shape charge into the charge holder of a perforation gun. When the charges are all installed, and the detonation cord is properly linked between each charge, then the charge holder can be placed in a carrier.

5 Claims, 8 Drawing Sheets

METHOD AND APPARATUS FOR LOCKING CHARGES INTO A CHARGE HOLDER

TECHNICAL FIELD OF THE INVENTION

The present invention relates to an improved method and apparatus for locking shape charges into a charge holder for use in well perforation operations. The improved apparatus eliminates the need to bend tabs on the charge holder to hold the charges in position.

BACKGROUND OF THE INVENTION

The performance of an underground well, such as a hydrocarbon producing well, can be improved by perforating the formation containing the hydrocarbons. Well perforation operations involve the controlled detonation of shape charges within the well. The shape charges perforate the casing, if any, and the surrounding formation, thereby improving the flow of hydrocarbons from the well. A perforation gun is used to hold the shape charges. The perforation gun is lowered into the well on either tubing or a wireline until it is at the depth of the formation of interest. The gun assembly includes a charge holder that holds the shape charges and a carrier that protects the shape charges from the environment. A detonation cord links each charge located in the charge holder.

A shaped charge is inserted into a mating hole of the charge holder, and a charge retention apparatus holds the charge firmly within the mating hole. The charge retention apparatus normally include retaining rings, charge retention jackets, clips, or bending tabs, all of which are designed to secure the shaped charge in the charge holder. Thus, it is desirable to provide a method and apparatus for securing the shaped charge to the charge holder of a perforating gun without using a separate charge retention apparatus or bendable tabs.

An example of a common charge retention design is shown in FIGS. 1 to 5. A perforation gun 10 is shown having a charge holder 12 and a cover (not shown). The charge holder has at least one opening 16 for receiving the shape charge 18. Each shape charge 18 has a case 20 that is generally conical in shape. An explosive charge is nestled into the case 20. Most cases 20 also have a pair of tabs 22 that retain the detonation cord 24. The detonation cord 24 can ignite the explosive charge through a detonation transfer passage 32 through the case 20. The carrier can have scalloping 26 that corresponds to the location of each charge. The scalloping is an area of reduced thickness used to minimize any resistance to the exploding shape charge.

The gun is assembled by sequentially placing the charges 18 into the charge holder 12. Once inserted, the charge must be secured in place. At least one deformable tab 30 can be used. The tip of a tool such as a screw driver is inserted into slot 28, as shown in FIG. 2, and the tab 30 is deformed until it is in contact with the front of the charge case. There are obvious drawbacks to such a retention scheme. For one, fabrication of the slot 28 is expensive and time consuming. The charge holders 12 are typically made of steel and the slots require an additional fabrication step to cut. Further, the deformation of the tab 30 takes additional assembly time. It also causes a minor deformation to the rest of the charge holder. When many tabs are deformed, the overall charge holder can experience a meaningful length increase. The deformation of the charge holder can also cause a misalignment of the charges and scalloping 26 on the carrier. Equally troublesome is the inability to easily disassemble the loaded charge holder. If the perforation gun is lowered into a well and for an unknown reason fails to fire, the gun is removed from the well and disassembled. This requires a worker to remove the charge holder from the carrier and then use a tool to undeform the tabs 30 to remove the charge. The use of the tool around the live charges introduces a safety concern. Also, once disassembled, the charge holder is unusable and must be scrapped.

A need exists for an easier and less expensive method to load charges into a charge holder. Such a method should use an improved charge holder design that does not require the use of deformable tabs. One attempt at making such a charge holder is shown in U.S. Pat. No. 5,952,603 to Parrott and entitled "Insert and Twist Method and Apparatus for Securing a Shaped Charge to a Loading Tube or a Perforating Gun." Rather than the use of tabs, Parrott '603 discloses the use of specially designed lugs on the charge case. In FIGS. 6 and 7 illustrate an embodiment of the Parrott '603 design. A shaped charge case 52 is inserted into a mating hole 54 of a loading tube 50 prior to inserting the loading tube in a perforating gun carrier. The pair of retaining lugs 52*a* are inserted into slots 54*a* and 54*b* of the mating hole 54 and, simultaneously, the pair of shoulder lugs 52*c* are inserted into the first and second pair of grooves 54*c* and 54*d*, the lugs 52*c* being initially inserted into the large diameter groove L associated with the first and second pair of grooves 54*c*, 54*d*. At this point, a wrench is required. The wrench is secured to the pair of support lugs 52*b* and twisted clockwise. The clockwise torque provided by the wrench on the support lugs 52*b* moves the shaped charge case 52 in a clockwise circumferential direction.

In FIG. 7, during the movement of the shaped charge case 52 in the clockwise circumferential direction, an end portion of the retaining lugs 52*a* move underneath a surface of the loading tube 50. Simultaneously, the pair of shoulder lugs 52*c* move out of the large diameter groove L of the pair of grooves 54*c* and 54*d* and into the small diameter groove S of the pair of grooves 54*c* and 54*d*. In this position, the surface of the loading tube 50 prevents the retaining lugs 52*a* of the shaped charge case 52 from moving in an outward radial direction; and the small diameter groove S prevents the shoulder lugs 52*c* from moving in an inward radial direction. In addition, the small diameter groove S of the first and second pair of grooves 54*c* and 54*d* prevents the shaped charge case 52 from moving either clockwise or counterclockwise in a circumferential direction.

The Parrot '603 design is exceedingly difficult and expensive to fabricate. For example, most charge cases are made of either steel or zinc. To place the lugs on a steel case requires a welding step or a very expensive lathing process. Zinc can be cast, and therefore to be cost effective, one is essentially limited to the use of a zinc case. Therefore, a need exists for a simpler and less expensive apparatus for holding shape charges in a carrier. Such an apparatus should not require expensive milling steps to construct and should quick to assemble and disassemble. In the event of disassembly, the carrier should be reusable.

SUMMARY OF THE INVENTION

The present invention addresses many of the drawbacks found in prior art retention schemes. In one embodiment, the invention uses a pair of opposed tabs on the carrier to engage a groove in the case of the shape charge. The case is generally conical in shape. However, the front opening of the case has both a first and second circumferential ridge separated by a groove. The diameter of the groove generally matches the distance between tabs. The second ridge can have a flat milled thereon to allow case to be inserted until the tabs contact the forward or first ridge. This locates the tabs between the first and second ridges and over the groove. The case is then rotated so that the tabs are captured between the two ridges. In another embodiment, there is no forward ridge, and the tab only contacts the rear ridge.

Once installed, the detonation cord is attached to the case. The cord helps prevent any rotation of the case, thereby securing it into the charge holder. Thus, the use of easily milled tabs on the charge holder in conjunction with an easily milled groove and flats on the case provide an improved apparatus and method for securing the shape charge into the charge holder of a perforation gun. When the charges are all installed, and the detonation cord is properly linked between each charge, then the charge holder can be placed in a carrier.

If a need arises for disassembling the perforation gun, the charge holder can be removed from the carrier. The detonation cord is then uncoupled from the charges to be removed. The charge case can then be simply turned until the tabs on the charge holder are aligned with the flats on the first ridge. The charge case is then pulled from the charge holder, leaving the charge holder in condition to be used again. No tools are required for this operation.

BRIEF DESCRIPTION OF THE DRAWINGS

The novel features believed characteristic of the invention are set forth in the appended claims. The invention itself, however, as well as a preferred mode of use, further objects and advantages thereof, will best be understood by reference to the following detailed description of an illustrative embodiment when read in conjunction with the accompanying drawings, wherein:

DETAILED DESCRIPTION OF THE DRAWING

Figure 8:
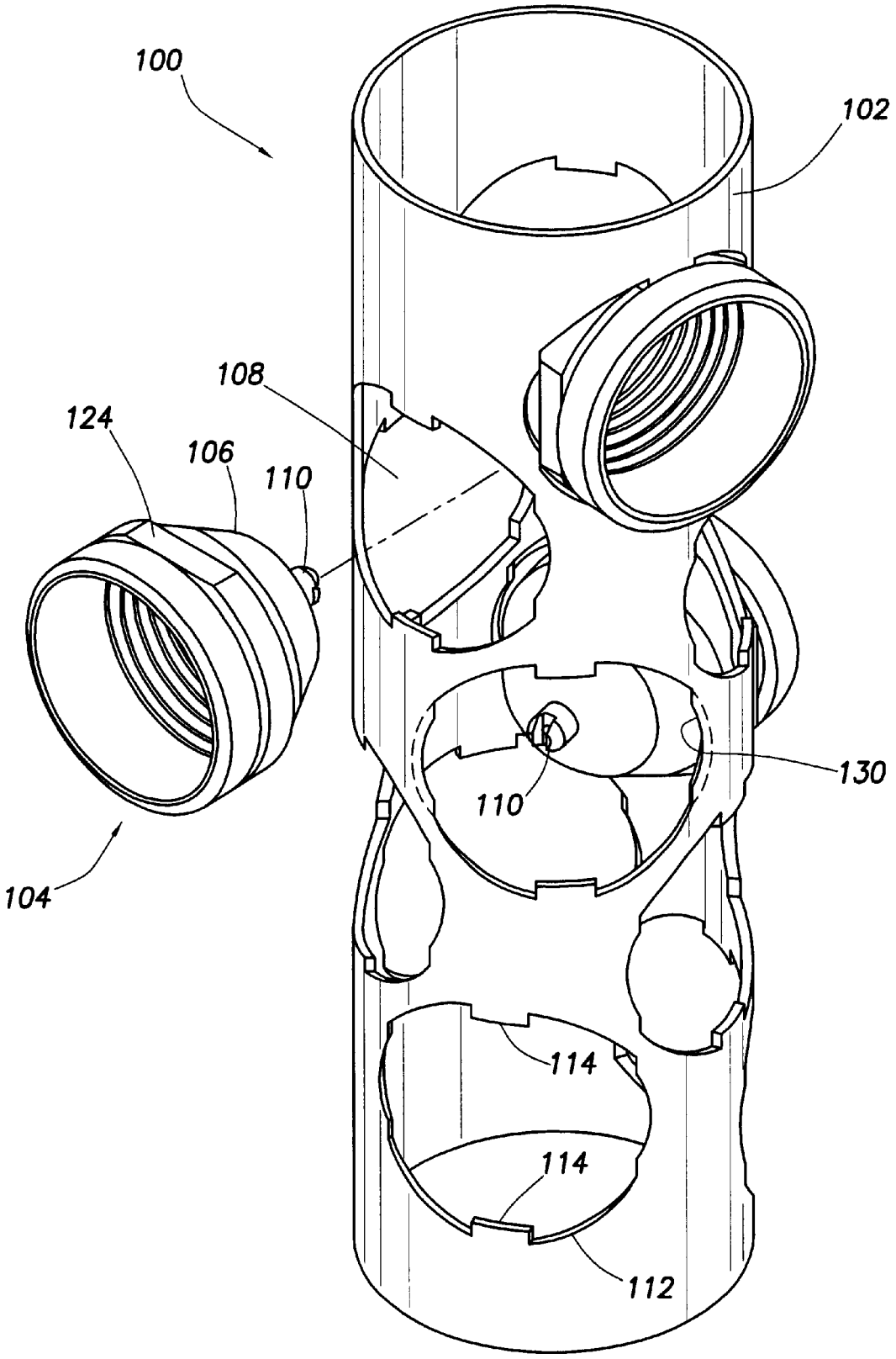
FIG. 8 is an exploded view of one embodiment of the present invention wherein tabs are located on the charge holder that engage a groove on the shape charge case.
Figure 9:
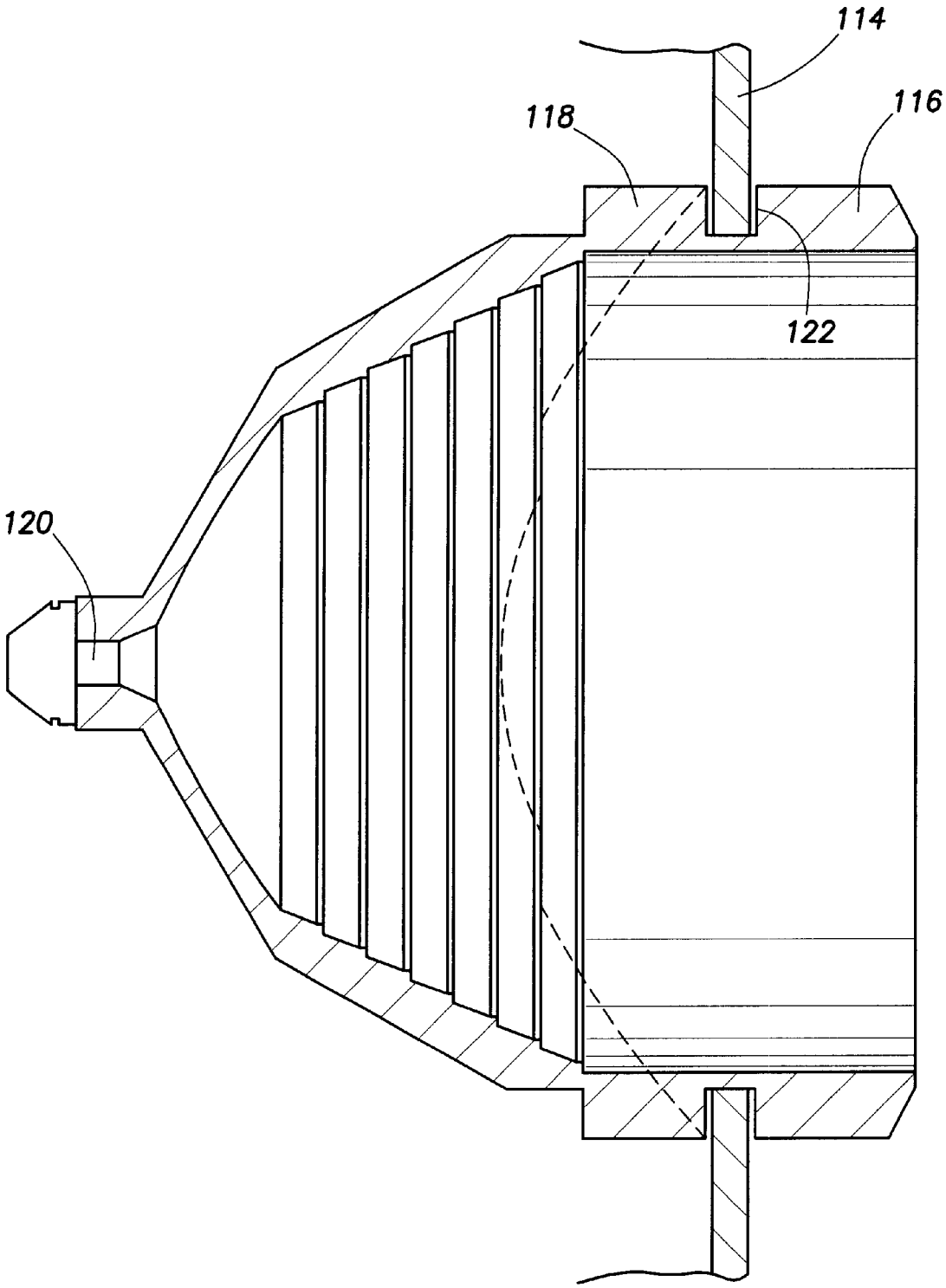
FIG. 9 is a side sectional view of one embodiment of the case for a shape charge in accordance with the present invention.

The present invention overcomes the disadvantages of prior art perforation gun assemblies by being easy to fabricate, easy to assemble, and easy to disassemble. Referring to FIGS. 8 and 9, an embodiment of the present invention is disclosed. The perforation gun assembly 100 comprises a charge holder 102 that contains at least one shape charge 104. The charge holder is typically a cylindrical loading tube having a plurality of holes, and at least one hole, disposed through its wall. Each shape charge 104 is formed by a case 106 that can contain an explosive charge. The case 106 is generally conical in shape with a narrowed end that is received into a hole 108 in the charge holder 102. The narrowed end of each case includes a detonation cord receiver 110 for receiving a detonation cord. A passage 120 through the wall of the case allows the detonation cord to ignite the explosive charge within the case.

The charge holder 102 can have a plurality of holes 108 for receiving a plurality of shape charges 104. However, not every hole must be used. Indeed, the spacing of the holes can vary significantly according the firing pattern desired for a particular formation. It is common for the charges to be placed in an angular pattern; although, a single straight line of charges may be appropriate in some circumstances as well. Further, the number of charges per linear foot of carrier is also an important criteria. It is common for a well engineer to specify between four to six charges per foot of carrier.

Figure 1:
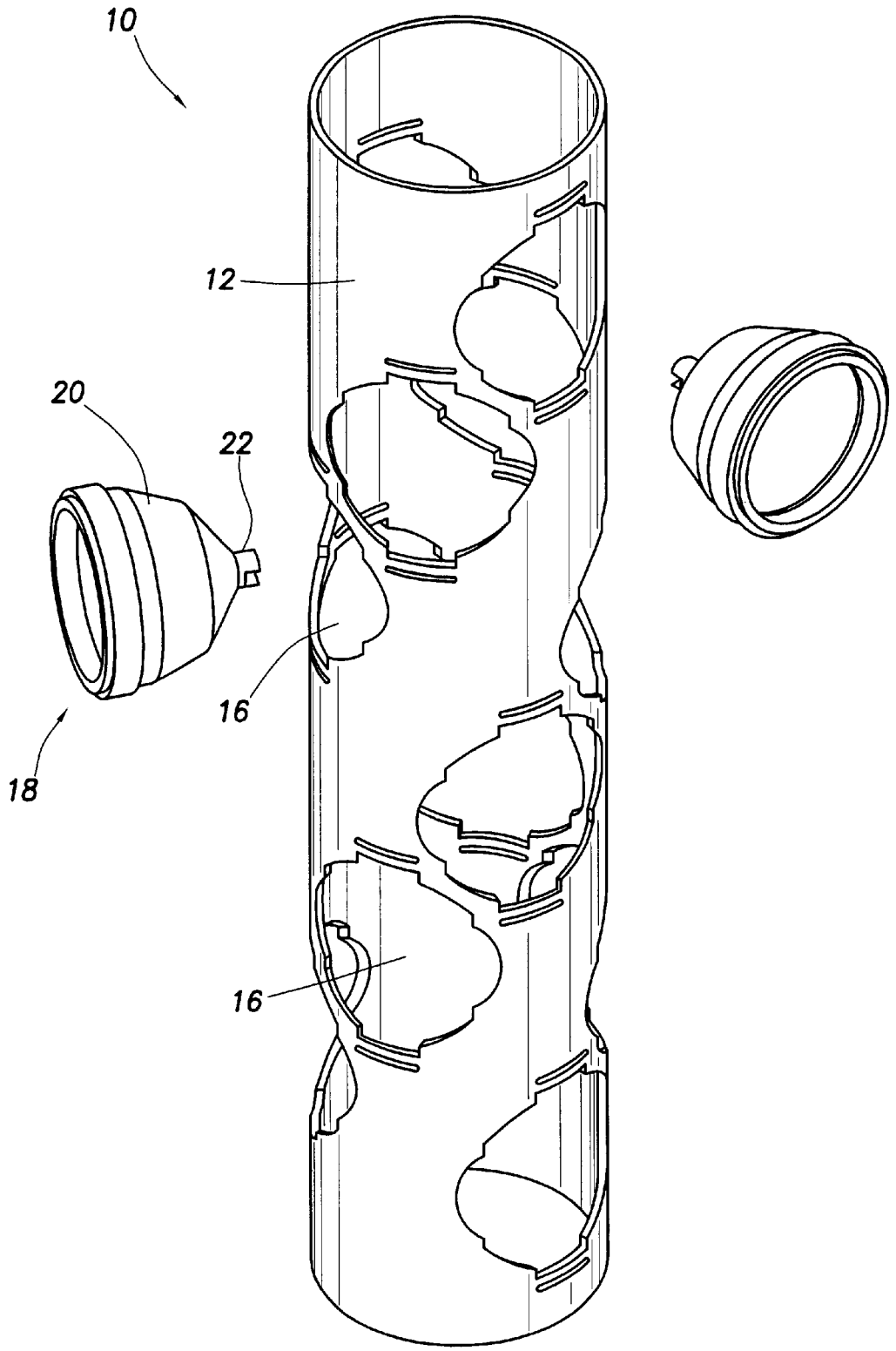
FIG. 1 (PRIOR ART)
FIG. 1 is an exploded view of a prior art charge holder tube with deformable tabs and shape charge cases shown aligned with holes in the charge holder.
Figure 2:
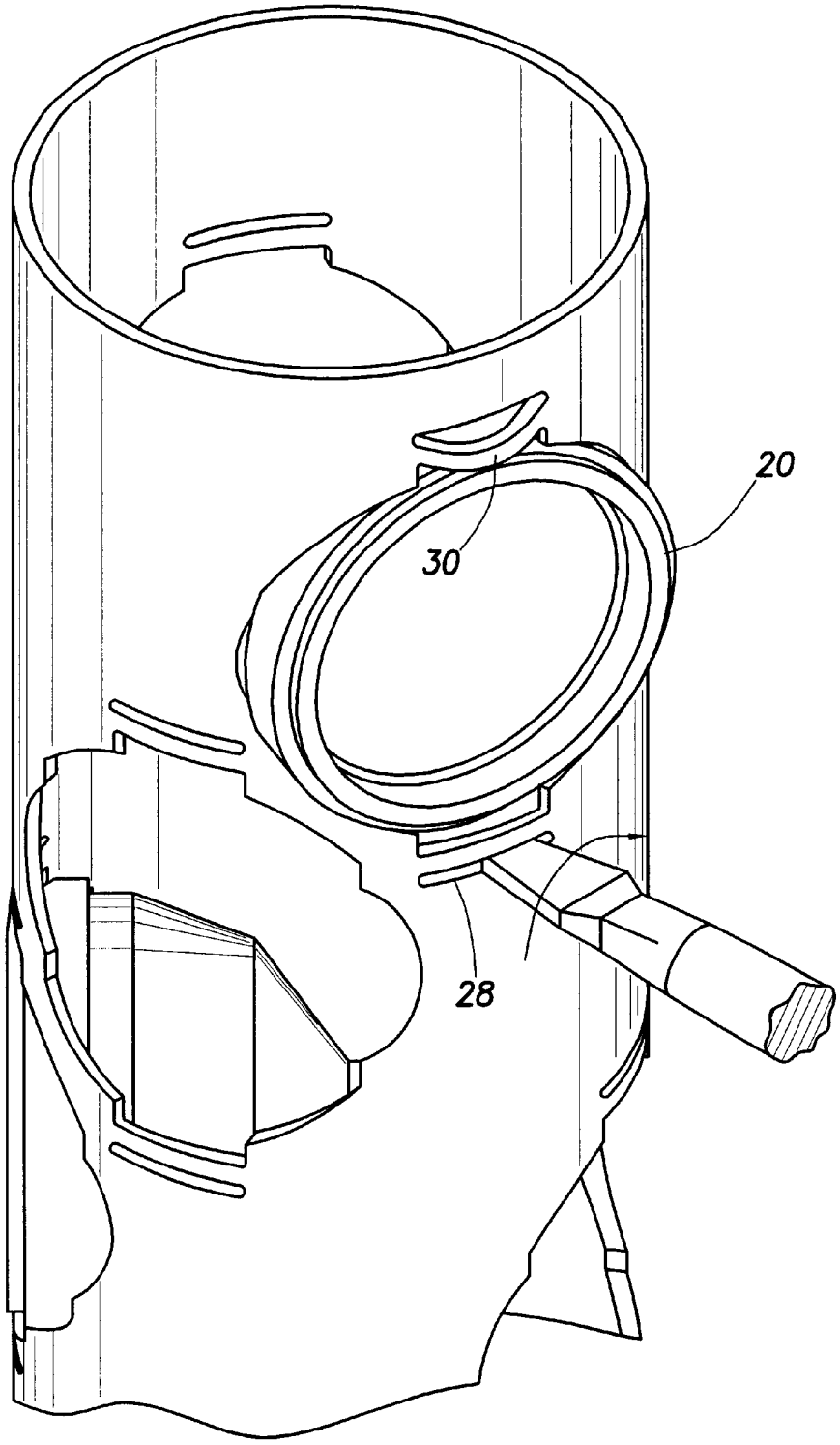
FIG.2 (PRIOR ART)
FIG. 2 is a perspective of a charge holder tube assembly showing a shape charge case installed and the tab being deformed by a tool.
Figure 3:
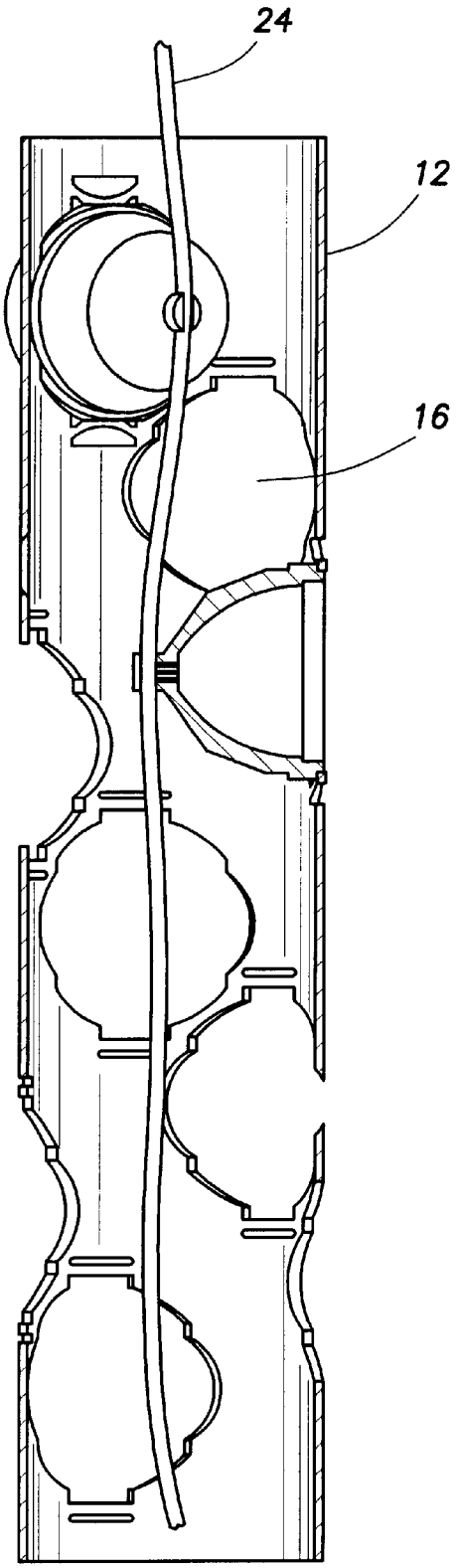
FIG.3 (PRIOR ART)
FIGS. 3 and 4 are sectionals showing the detonation cord connected between tabs on the rear of each case.
Figure 4:
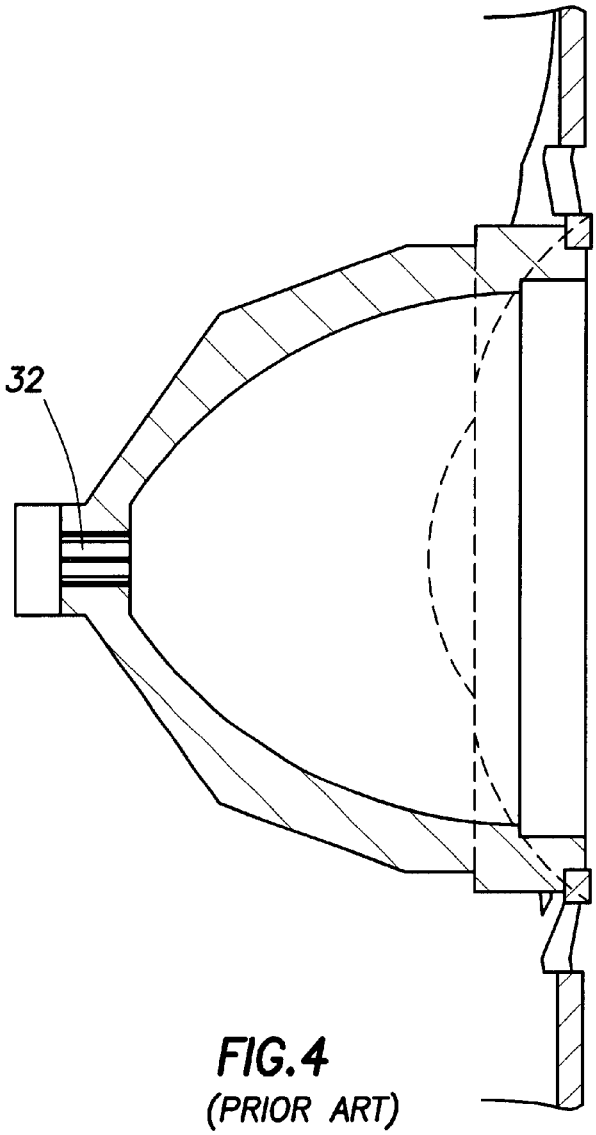
FIG.4 (PRIOR ART)
Figure 5:
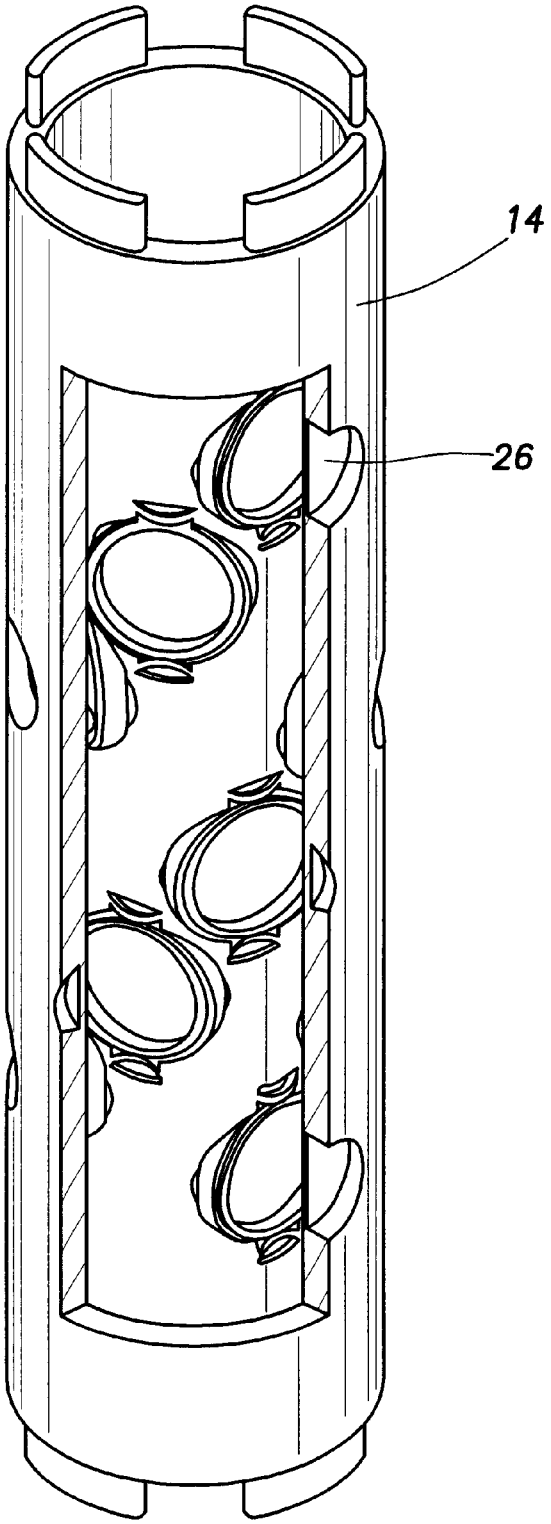
FIG.5 (PRIOR ART)
FIG. 5 shows a cut-away view of a scalloped case over the charge holder shown in FIGS. 1 to 4.
Figure 6:
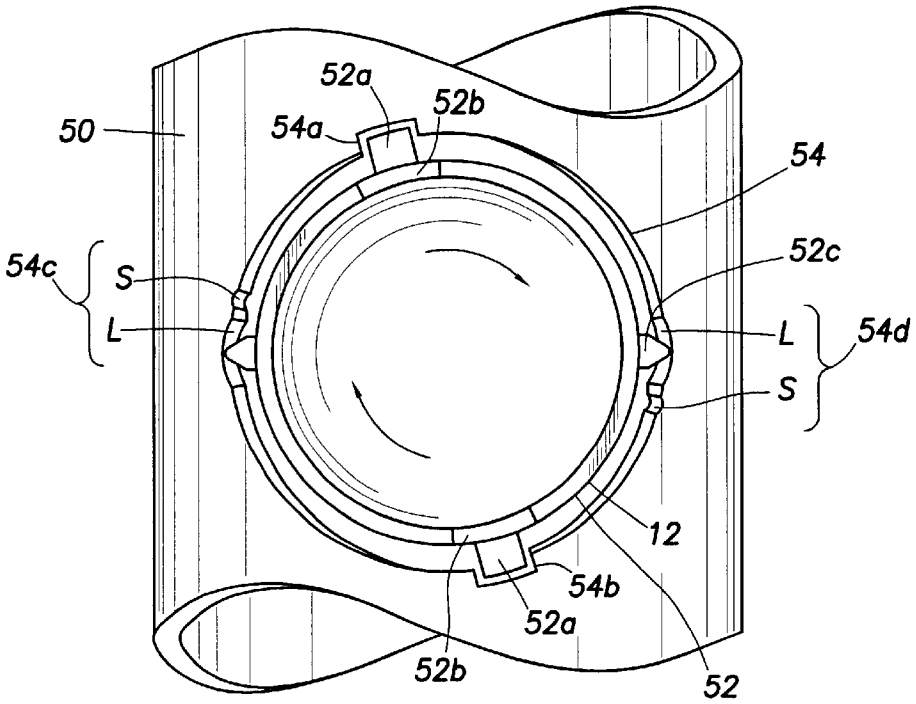
FIG.6 (PRIOR ART)
FIGS. 6 and 7 illustrate another prior art charge holder design that utilizes lugs on the shape charge case.
Figure 7:
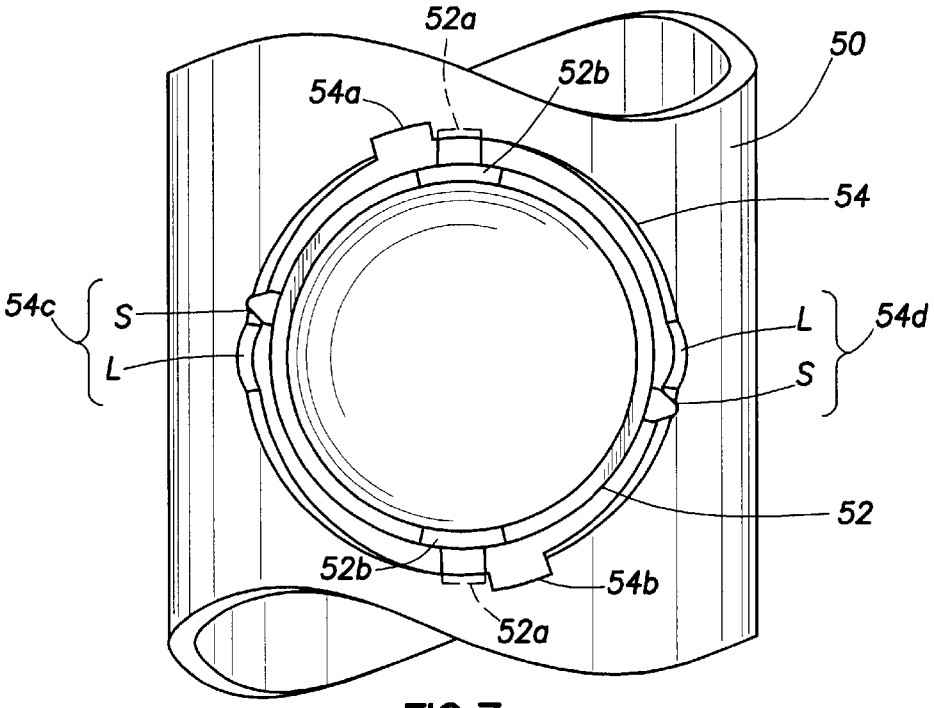
FIG.7 (PRIOR ART)

Each hole 108 is defined by a uniquely shaped circumference 112. The circumference 112 has at least one tab 114. The charge holder shown in FIG. 8 has two tabs per hole; however, more could be used. In one embodiment, the case 106 can have a first ridge 116 and a second ridge 118 around its circumference. The first ridge 116 is forward from the second ridge 118. A groove 122 is defined between the two ridges. Moreover, the second ridge 118 has a flat 124 that corresponds to each tab 114. FIGS. 7 and 8 illustrate an embodiment for the present invention wherein two tabs 114 are placed opposite each other on the circumference 112. The distance between the ends of each tab 114 can closely approximate the diameter of the groove 122. Likewise, the width of the tabs 114 can closely approximate the width of the groove 122.

The flats 124 allow the tabs to pass over the second ridge 118 until they contact the first ridge 116. Of course, a flat is simply one geometry to allow the tab to enter the groove. A complementary shape cut could also allow the tab to pass over the forward ridge and into the groove. Once the tabs 114 are in the groove 122, a simple rotation of the case 106 captures the tabs between the first and second ridges, thereby preventing the case from disengaging the charge holder 102. The detonation cord is then coupled to the cord retainer on the case. This minimizes the risk of the case rotating to a position where the tabs and flats are again adjacent. Once the charges are installed into the charge holder, a carrier (not shown) may be placed over the charge holder to protect the integrity of the shaped charges.

Figure 10:
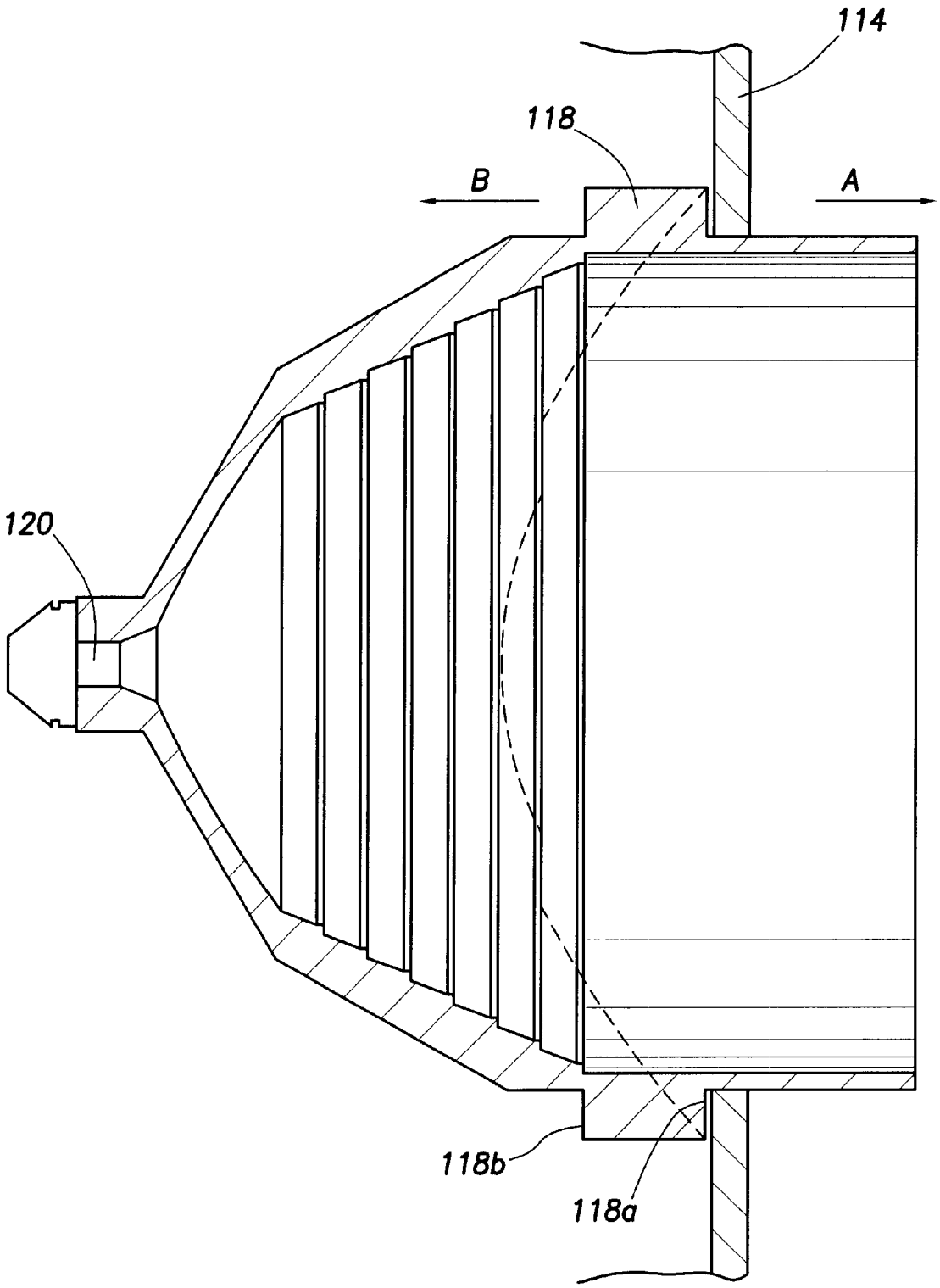
FIG. 10 is a side sectional view of another embodiment of the case for a shape charge.

The use of tabs on the circumference of each hole 108 is far easier to manufacture than a deformable tab or lugs on the charge case. Most charge holders can be laser cut. The present invention only requires a modification to the circumference of each hole and does not require the cutting of an additional slot. Another feature of hole 108 can be a reduced diameter portion 130. This feature can provide added stability to the individual charge cases. In one embodiment, shown in FIG. 10, the case does not have a forward ridge 116. Instead, the case has only the rear ridge 118. In this embodiment, the case can not move in the direction of arrow A because of contact between the tab 114 and surface 118*a* of rear ridge 118. Likewise, the case can not move in the direction of arrow B because of contact between surface 118*b* of rear ridge 118 and reduced diameter portion 130. With either embodiment, the case is secure in the loading tube.

Although preferred embodiments of the present invention have been described in the foregoing detailed description and illustrated in the accompanying drawings, it will be understood that the invention is not limited to the embodiments disclosed but is capable of numerous rearrangements, modifications, and substitutions of steps without departing from the spirit of the invention. Accordingly, the present invention is intended to encompass such rearrangements, modifications, and substitutions of steps as fall within the scope of the appended claims.

We claim:

1. A charge holder for accepting an explosive charge in a case, said charge holder comprising:

a loading tube including at least one hole disposed through a wall of said loading tube, said hole having a circumference defining at least one tab;

wherein said case further comprises a first and second ridge defining a groove between, and a flat on the second ridge to allow the at least one tab access to said groove.

2. The charge holder of claim 1 wherein said case comprises a rear ridge.

3. The charge holder of claim 1 wherein said case further defines a cord retainer for retaining a detonation cord.

4. The charge holder of claim 3 wherein the circumference has a diameter approximately equal to a diameter of the first ridge.

5. The charge holder of claim 3 wherein said tab has a length approximately equal to a depth of the groove.

* * * * *

US006487973C1

(12) EX PARTE REEXAMINATION CERTIFICATE (6206th)

United States Patent

Gilbert, Jr. et al.

(10) Number: US 6,487,973 C1

(45) Certificate Issued: Apr. 22, 2008

(54) METHOD AND APPARATUS FOR LOCKING CHARGES INTO A CHARGE HOLDER

(76) Inventors: William James Gilbert, Jr., 8301 C. R. 1206, Rio Vista, TX (US) 76093; Corbin Glenn, 1009 Bryant, Benbrook, TX (US) 76126

Reexamination Request:
No. 90/006,847, Nov. 6, 2003

Reexamination Certificate for:

| | |
|---|---|
| Patent No.: | **6,487,973** |
| Issued: | **Dec. 3, 2002** |
| Appl. No.: | **09/558,694** |
| Filed: | **Apr. 25, 2000** |

(51) Int. Cl.
*F42B 3/00* (2006.01)

(52) U.S. Cl. ..... 102/312; 102/313

(58) Field of Classification Search ..... None
See application file for complete search history.

(56) References Cited

U.S. PATENT DOCUMENTS 3,048,101 A * 8/1962 Lebourg ..... 175/4.6
4,694,754 A * 9/1987 Dines et al. ..... 102/310
4,915,029 A * 4/1990 Appledorn et al. ..... 102/310

* cited by examiner

*Primary Examiner*—Matthew C. Graham

(57) ABSTRACT

The invention uses a pair of opposed tabs on the charge holder to engage a groove in the case of the shape charge. The case is generally conical in shape. However, the front opening of the case has both a first and second circumferential ridge separated by a groove. The diameter of the groove generally matches the distance between tabs. The second ridge can have a flat milled thereon to allow case to be inserted until the tabs contact the forward or first ridge. This locates the tabs between the first and second ridges and over the groove. The case is then rotated so that the tabs are captured between the two ridges. Once installed, the detonation cord is attached to the case. The cord helps prevent any rotation of the case, thereby securing it into the charge holder. Thus, the use of easily milled tabs on the charge holder in conjunction with an easily milled groove and flats on the case provide an improved apparatus and method for securing the shape charge into the charge holder of a perforation gun. When the charges are all installed, and the detonation cord is properly linked between each charge, then the charge holder can be placed in a carrier.

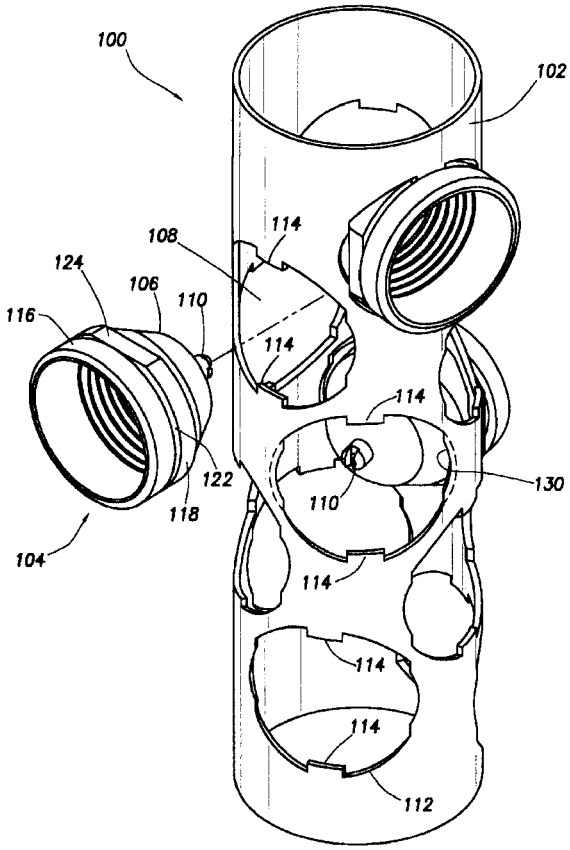

(Amended)

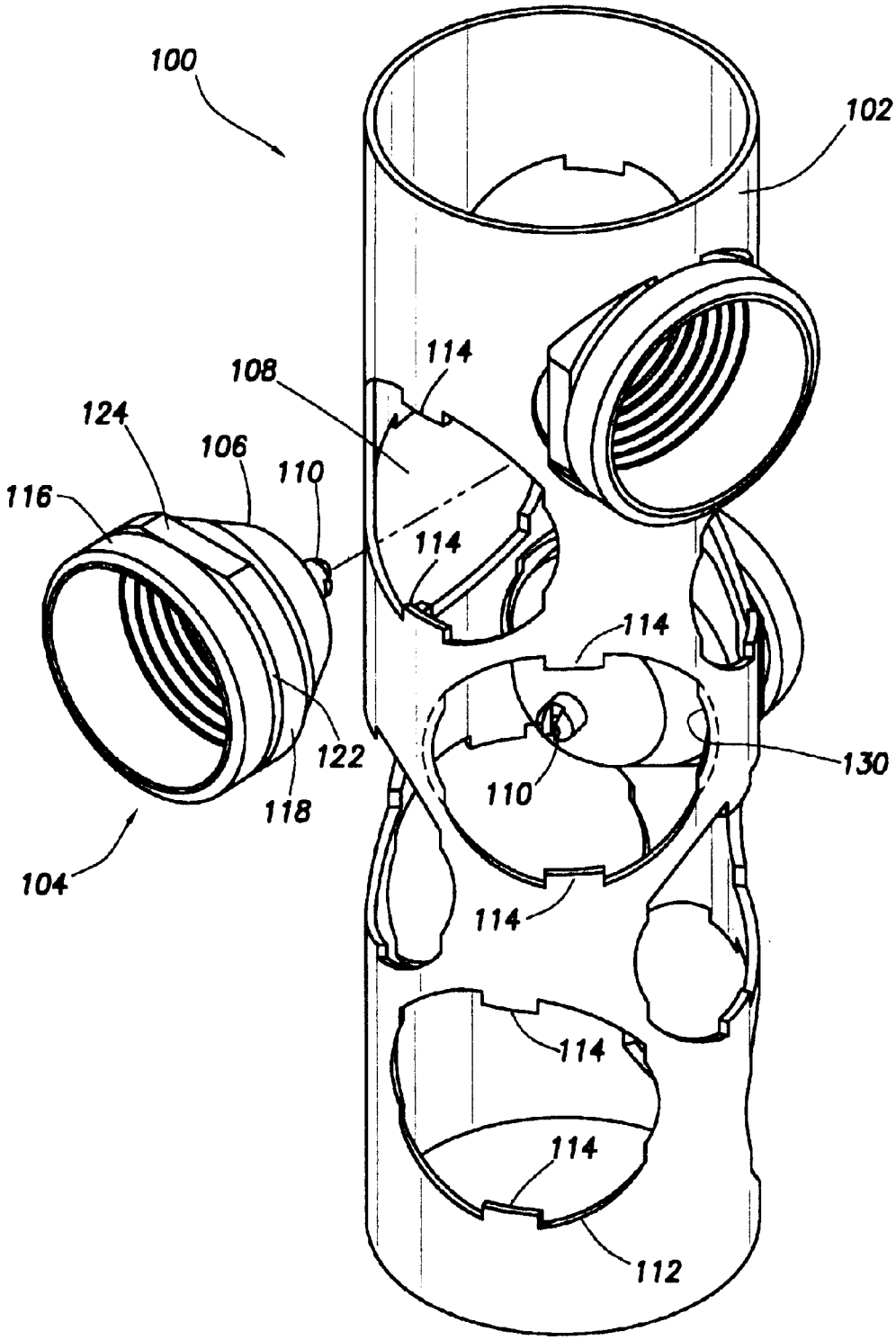
FIG.8
(Amended)

EX PARTE REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

THE DRAWING FIGURES HAVE BEEN CHANGED AS FOLLOWS:

Ref. numerals 114, 116, 118 and 122 have been added to FIG. 8.

AS A RESULT OF REEXAMINATION, IT HAS BEEN DETERMINED THAT:

Claims 1–5 are determined to be patentable as amended.

New claim 6 is added and determined to be patentable.

1. A charge holder [for accepting an explosive charge in a case] *assembly,* [said charge holder] comprising:

*a*) a *cylindrical* loading tube [including] *having* at least one hole disposed through a wall of said loading tube, said hole having a circumference defining at least [one tab] *two opposing tabs extending into said hole*; *and*

*b*) *an explosive charge formed in a case,* [wherein] said case [further comprises] *having* a first and second *circumferential* ridge *extending away from an outer surface of said case and* defining a groove [between] therebetween, [and a flat on the] *said* second ridge *having a flat portion* to allow [the at least one tab] *said tabs* access to said groove*;*

*wherein, said case is selectively coupled to said loading tube by aligning said flat portion with said tabs allowing said tabs access to said groove and rotating said case in said hole so that said tabs are captured between said ridges*.

2. The charge holder *assembly* of claim 1 wherein said [case comprises a rear ridge] *hole further comprises a reduced diameter portion*.

3. The charge holder *assembly* of claim 1 wherein said case further defines a cord retainer for retaining a detonation cord.

4. The charge holder *assembly* of claim 3 wherein the circumference *of said hole* has a *maximum* diameter approximately equal to a diameter of the first *circumferential* ridge.

5. The charge holder *assembly* of claim 3 wherein said [tab has] *tabs extend into said hole* a length approximately equal to a depth of the groove.

*6. The charge holder assembly of claim 2 wherein said second circumferential ridge further includes a first and second surface extending substantially perpendicularly away from said case such that when said case is rotated in said hole, said tabs are captured between said first surface and said first ridge and said second surface engages said reduced diameter area.*

* * * * *